US010607516B2

(12) United States Patent
Mao et al.

(10) Patent No.: US 10,607,516 B2
(45) Date of Patent: Mar. 31, 2020

(54) DISPLAY DEVICE AND LIGHT SOURCE DEVICE HAVING VARIOUS TYPES OF LIGHT-EMITTING COMPONENTS

(71) Applicant: Innolux Corporation, Miao-Li County (TW)

(72) Inventors: Li-Wei Mao, Miao-Li County (TW); Chung-Kuang Wei, Miao-Li County (TW); Ming-Chia Shih, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 96 days.

(21) Appl. No.: 15/861,686

(22) Filed: Jan. 4, 2018

(65) Prior Publication Data

US 2018/0197444 A1 Jul. 12, 2018

Related U.S. Application Data

(60) Provisional application No. 62/442,992, filed on Jan. 6, 2017.

(30) Foreign Application Priority Data

Apr. 28, 2017 (CN) ..... 2017 1 0292493

(51) Int. Cl.

| | |
|---|---|
| ***G09F 13/22*** | (2006.01) |
| ***F21V 9/08*** | (2018.01) |
| ***G09F 9/33*** | (2006.01) |
| ***G09F 9/302*** | (2006.01) |

(52) U.S. Cl.

CPC ..... *G09F 13/22* (2013.01); *F21V 9/08* (2013.01); *G09F 9/3026* (2013.01); *G09F 9/33* (2013.01); *G09G 2310/0264* (2013.01); *G09G 2310/06* (2013.01)

(58) Field of Classification Search

CPC ..... G09F 13/22; G09F 9/3026; G09F 9/33; F21V 9/08

See application file for complete search history.

(56) References Cited

U.S. PATENT DOCUMENTS 8,637,877 B2 * 1/2014 Negley ..... H01L 33/507 257/88
9,074,738 B2 * 7/2015 Guo ..... F21K 9/90

* cited by examiner

*Primary Examiner* — Joseph L Williams
(74) *Attorney, Agent, or Firm* — JCIPRNET

(57) ABSTRACT

The disclosure provides a display device including a display panel and a light source module. The light source module is arranged on one side of the display panel and provides a display light source to the display panel. The light source module includes a first light-emitting component and a second light-emitting component. The first light-emitting component includes a first electroluminescent structure. The second light-emitting component includes a second electroluminescent structure. The second light-emitting component includes a wavelength-converting material, while the first light-emitting component does not include any wavelength-converting material. The display device is able to provide an ideal light source without consuming significant energy.

18 Claims, 6 Drawing Sheets

DISPLAY DEVICE AND LIGHT SOURCE DEVICE HAVING VARIOUS TYPES OF LIGHT-EMITTING COMPONENTS

CROSS-REFERENCE TO RELATED APPLICATION

This application claims the priority benefits of U.S. provisional application Ser. No. 62/442,992, filed on Jan. 6, 2017, and China application serial no. 201710292493.4, filed on Apr. 28, 2017. The entirety of each of the above-mentioned patent applications is hereby incorporated by reference herein and made a part of this specification.

BACKGROUND

Field of the Disclosure

The disclosure relates to a display device and a light source device.

Description of Related Art

As the display technology has been continuously improved, display devices are applied in more and more fields, and sizes of the display devices also increase. The display devices of large sizes face problems of not only frame quality but also large energy consumption. For example, non-self-luminescent display panels, such as liquid crystal display panels, need to be equipped with light source modules which provide required display light. As the sizes of the display panels increase, the light source modules need to provide a planar light source occupying a large area, which is the main cause to the large energy consumption.

SUMMARY

The disclosure is directed to a display device having good light-emitting efficiency and color-displaying quality.

The disclosure is also directed to a light source module having good light-emitting efficiency.

According an embodiment of the disclosure, a display device includes a display panel and a light source module. The light source module is arranged on a side of the display panel and provides a display light source to the display panel. The light source module includes at least one first light-emitting component and at least one second light-emitting component. The at least one first light-emitting component includes at least one first electroluminescent structure. The at least one second light-emitting component includes a second electroluminescent structure. The at least one second light-emitting component further includes a wavelength-converting material, but the at least one first light-emitting component does not include any wavelength-converting material.

According an embodiment of the disclosure, a light source device including a plurality of first light-emitting components and a plurality of second light-emitting components. One of the first light-emitting components includes at least one first electroluminescent structure. One of the second light-emitting components includes a second electroluminescent structure, wherein the one of the second light-emitting components includes a wavelength-converting material, but the one of the first light-emitting components does not include a wavelength-converting material.

The light source module and the display device of the disclosure provide an ideal light source on a relatively energy-saving condition.

To make the above features and advantages of the invention more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION

Figure 1:
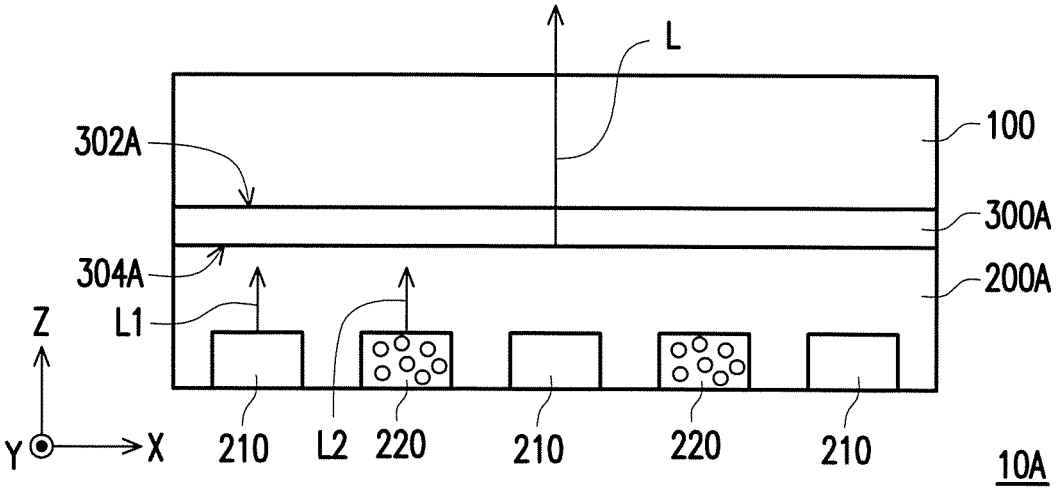
FIG. 1 is a schematic view of a display device of the disclosure.

Reference will now be made in detail to the present embodiments of the disclosure, examples of which are illustrated in the accompanying drawings. Wherever possible, the same reference numbers are used in the drawings and the description to refer to the same or like parts.

Descriptions of a structure (e.g., a layer, a component, or a material) located on another structure (e.g., a layer, a component, or a material) in this disclosure may refer to two structures that are adjacent and directly connected to each other or two structures that are adjacent but not directly connected to each other. At least one intermediate structure (e.g., an intermediate layer, an intermediate component, an intermediate material, or an intermediate gap) is situated between two structures when the two structures are not directly connected to each other. A lower surface of one of the two structures is adjacent or is directly connected to an upper surface of the intermediate structure, and an upper surface of the other structure is adjacent or is directly connected to a lower surface of the intermediate structure. The intermediate structure may be constructed by a single-layered or multi-layered physical structure or a non-physical structure and is not limited thereto. In this disclosure, when a structure is described as being located "on" another structure, it may indicate that the structure is "directly" located on another structure, or the structure is "indirectly"

located on another structure; that is, at least one structure is situated between the structure and another structure.

When two objects are electrically connected or coupled to each other in this disclosure, the two objects may be directly or indirectly connected to each other. In a situation where the two objects are directly connected to each other, ends of components on two circuits are connected to each other directly or through a conductive line. In a situation where the two objects are indirectly connected to each other, a combination of one of a switch, a diode, a capacitor, an inductor, and other non-conductive-line components and at least one conductive line or one resistor is located between the ends of the components on the two circuits, or a combination of at least two of the above and at least one conductive line or one resistor is situated between the ends of the components on the two circuits.

In the disclosure, whenever it is applicable, identical or similar reference numbers are used to represent identical or similar components in drawings and descriptions. Additionally, in the disclosure, a "light-emitting color" of a light-emitting component refers to a color perceived by an observer after an electric current flows through the light-emitting component and the electromagnetic radiation generated by the light-emitting component is received by the observer's eyes. Colors perceivable by human eyes fall in the wavelength range of visible lights. In other words, when a wavelength of the electromagnetic radiation generated by the light-emitting component falls in a range from 400 nm to 700 nm, the electromagnetic radiation is a color light visible to human eyes. Generally, a wavelength of red light falls approximately in a range from 600 nm to 700 nm, a wavelength of green light falls approximately in a range from 500 nm to 580 nm, a wavelength of blue lights fall approximately in a range from 420 nm to 480 nm, and a wavelength of yellow light falls approximately in a range from 500 nm to 600 nm. Meanwhile, white light may be obtained by mixing red, green, and blue lights or by mixing blue and yellow lights, which should not be construed as a limitation to the disclosure. Thereby, in the disclosure, a frequency spectrum of the white light may include two peak wavelengths, three peak wavelengths, or more peak wavelengths, which should not be construed as a limitation to the disclosure. For example, in the frequency spectrum of the white light with three peak wavelengths, the three peak wavelengths respectively fall in the wavelength ranges of red light, green light, and blue light. Nevertheless, the disclosure is not limited thereto. In the frequency spectrum of the white light with two peak wavelengths, the two peak wavelengths may respectively fall in the wavelength ranges of blue light and yellow light or may have other peak wavelengths as long as the peak wavelengths can be mixed to generate the white light. The disclosure is not limited thereto. Ultraviolet light in this disclosure refers to light with a wavelength ranging approximately from 250 nm to 420 nm. In addition, different light-emitting peak wavelengths or different peak wavelengths in this disclosure may be two peak wavelengths respectively falling in the wavelength ranges of lights of different colors and the difference between the two wavelengths is equal to or greater than 50 nm. The different light-emitting peak wavelengths or the different peak wavelengths in this disclosure are presented in form of lights of different colors.

In this disclosure, each of the embodiments may be applied in combination without departing from the spirit and the scope of this disclosure. For example, some features provided in an embodiment may be combined with other features provided in another embodiment, which constitutes yet another embodiment.

Please refer to exemplary embodiments of the disclosure, wherein the descriptions of the exemplary embodiments are illustrated in the drawings. Identical reference numbers are used in the drawings and the descriptions to represent identical or similar components whenever it is applicable.

FIG. 1 is a schematic view of a display device of the disclosure. According to FIG. 1, a display device 10A includes a display panel 100 and a light source module 200A. Specifically, the display device 10A is a three-dimensional device, and FIG. 1 illustrates the display device 10A on an x-z plane in FIG. 1. The light source module 200A is arranged on a side of the display panel 100 and provides a display light source L to the display panel 100. The light source module 200A includes at least one first light-emitting component 210 and at least one second light-emitting component 220. In the drawings illustrating this embodiment, the quantity of the first light-emitting component 210 and that of the second light-emitting component 220 are a plural, but the disclosure is not limited thereto. In some alternative embodiments, at least one of the quantity of the first light-emitting component 210 and that of the second light-emitting component 220 may be one. In addition, in the drawings illustrating this embodiment, blank rectangles are used to represent the first light-emitting component 210, while rectangles filled with small dots are used to represent the second light-emitting component 220. More specifically, the difference between the first light-emitting component 210 and the second light-emitting component 220 lies in that the first light-emitting component 210 does not include any wavelength-converting material, while the second light-emitting component 220 includes a wavelength-converting material. According to FIG. 2, a plurality of the first light-emitting components 210 and a plurality of the second light-emitting components 220 are arranged in an array on the x-y plane and disposed in the light source module 200A. The first light-emitting components 210 and the second light-emitting components 220 may be alternately arranged, and the quantity of the first light-emitting components 210 may be the same as, i.e. equals, the quantity of the second light-emitting components 220; the disclosure is not limited thereto. In other embodiments, the first light-emitting components 210 and the second light-emitting components 220 may be in different numbers. In some other embodiments, the first light-emitting components 210 and the second light-emitting components 220 may be arranged in a different manner or may not be arranged in a matrix, which should not be construed as a limitation in the disclosure. In addition, the display device 10A in FIG. 1 may selectively include an optical plate 300A. The optical plate 300A has a light-exiting surface 302A facing the display panel 100 and a light-entering surface 304A opposite to the light-exiting surface 302A. Here, the optical plate 300A may include a diffusion sheet, a brightness enhancement film, a prism sheet, or a combination thereof; the disclosure is not limited thereto. In other words, the light source module 200A is a direct-type light source module, but the disclosure is not limited thereto. Light-exiting directions of the first light-emitting components 210 and the second light-emitting components 220 in the light source module 200A all face to the display panel 100.

Figure 3:
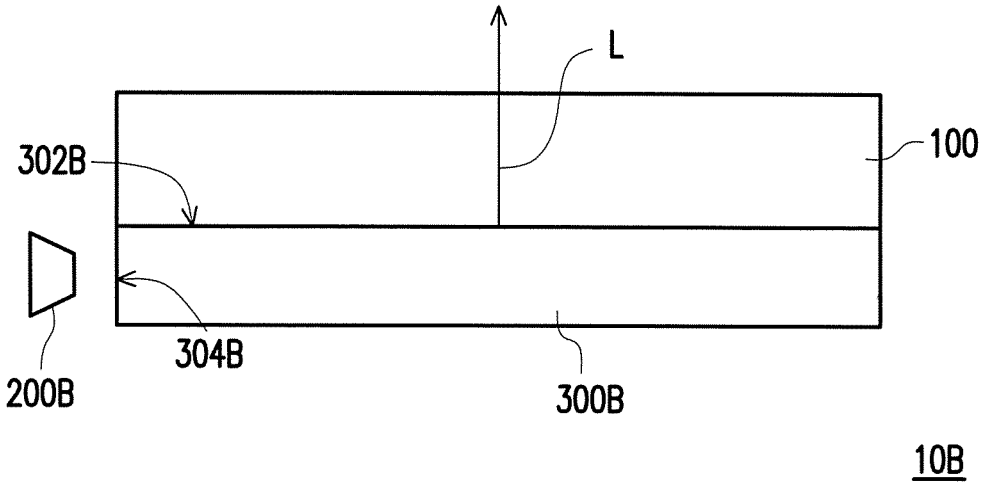
FIG. 3 is a schematic view of a display device of the disclosure.
Figure 4:
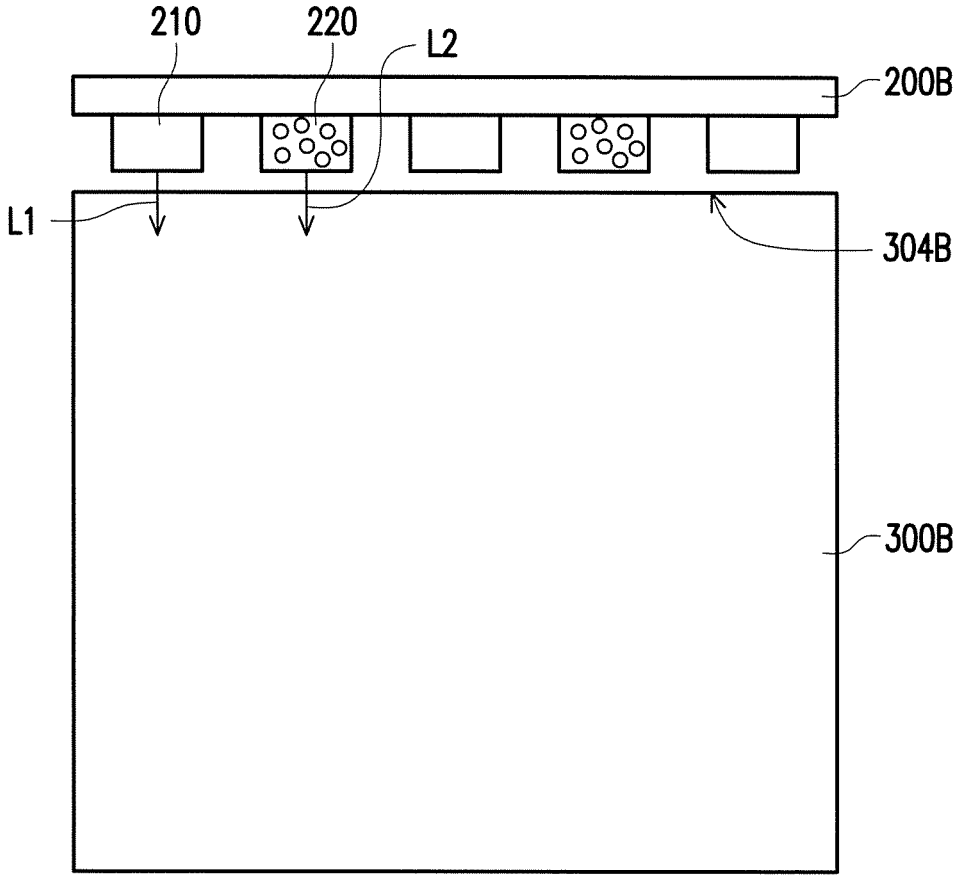
FIG. 4 is a schematic top-view of a light source module and an optical plate in the display device of FIG. 3.

FIGS. 3 and 4 illustrate a display device in another embodiment of the disclosure. According to FIG. 3, a display device 10B includes a display panel 100 and a light source module 200B. The light source module 200B is arranged on a side of the display panel 100 and provides a display light source L to the display panel 100. According to FIG. 4, the light source module 200B includes a first light-emitting component 210 and a second light-emitting component 220. In the drawings illustrating this embodiment, blank rectangles are used to represent the first light-emitting component 210, while rectangles filled with small dots are used to represent the second light-emitting component 220. More specifically, the difference between the first light-emitting component 210 and the second light-emitting component 220 lies in that the first light-emitting component 210 does not include any wavelength-converting material, while the second light-emitting component 220 includes a wavelength-converting material. According to FIG. 4, a plurality of the first light-emitting components 210 and a plurality of the second light-emitting components 220 are arranged in a row and disposed in the light source module 200B. The quantity of the first light-emitting components 210 may be the same as or different from the quantity of the second light-emitting components 220. Moreover, in FIG. 3, the display device 10B further includes a light guide plate 300B. The light guide plate 300B has a light-exiting surface 302B facing the display panel 100 and a light-entering surface 304B adjacently connected to the light-exiting surface 302B. Here, a diffusion sheet, a brightness enhancement film, a prism sheet, or a combination thereof may be further included between the light guide plate 300B and the display panel 100. In other words, the light source module 200B is an edge-type light source module.

In the display device 10A in FIG. 1 and the display device 10B in FIG. 3, the display panel 100 may further include a plurality of pixels arranged in an array. Each of the pixels may include a red sub-pixel, a green sub-pixel, and a blue sub-pixel in an embodiment and may include a red sub-pixel, a green sub-pixel, a blue sub-pixel, and a white sub-pixel in another embodiment. Colors of each of the pixels provided herein are merely exemplary and may be determined according to actual needs. Moreover, the arrangement of the colored sub-pixels may include a stripe type arrangement, a delta type arrangement, or other arrangements that are already adopted in the pertinent field.

In the display device 10A in FIG. 1 and the display device 10B in FIG. 3, the display light source L may be a white light instead of a visible light of a certain color, so as to be supplied to display a variety of colorful frames or a white frame. Hence, the first light-emitting components 210 and the second light-emitting components 220 may be implemented in a variety of ways. Some of the possible embodiments are provided below, but this disclosure is not limited thereto. Other embodiments also fall into the scope of this disclosure as long as the first light-emitting components 210 do not include any wavelength-converting material and the second light-emitting components 220 include a wavelength-converting material, and as long as the display light source L may be provided through the first light-emitting components 210 and the second light-emitting components 220.

Figure 5:
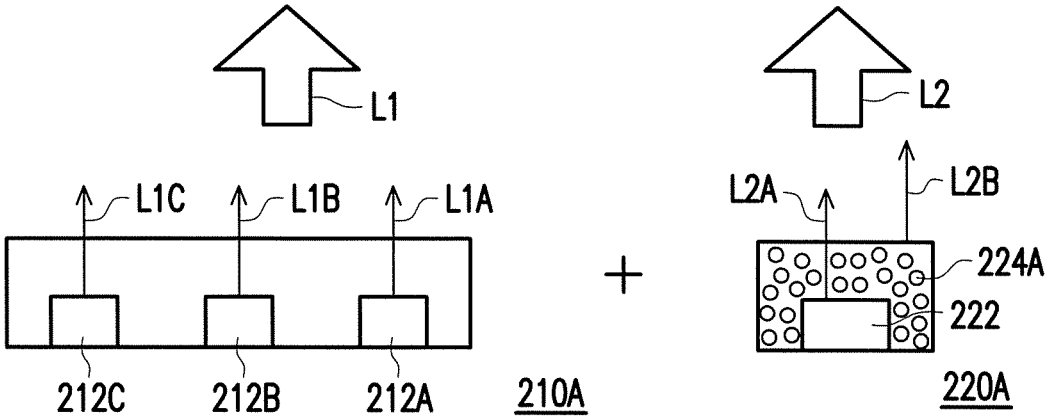
FIG. 5 is a schematic view of a combination of a first light-emitting component and a second light-emitting component in an embodiment of the disclosure.

FIG. 5 is a schematic view of a combination of a first light-emitting component and a second light-emitting component in an embodiment of the disclosure. According to FIG. 5, one first light-emitting component 210A includes a plurality of first electroluminescent structures 212A, 212B, and 212C. Each of the first electroluminescent structures 212A, 212B, and 212C respectively may be, for example, a light-emitting diode (LED) chip; but the disclosure is not limited thereto. In this embodiment, the first electroluminescent structures 212A, 212B, and 212C have different light-emitting peak wavelengths. When a driving current flows through the first electroluminescent structures 212A, 212B, and 212C, the first electroluminescent structures 212A, 212B, and 212C are able to respectively emit a first color light L1A, a second color light L1B, and a third color light L1C. Colors of the first color light L1A, the second color light L1B, and the third color light L1C may be different from one another. The first color light L1A, the second color light L1B, and the third color light L1C may constitute a first light source L1 of the first light-emitting component 210A. That is to say, the first light-emitting component 210A may be a packaged light-emitting component where LED chips emitting three different colors of visible lights are packaged together. In an embodiment, the first color light L1A, the second color light L1B, and the third color light L1C may respectively be a red light, a blue light, and a green light; the first light source L1 emitted by the first light-emitting component 210A may be a white light. At this time, a light-emitting frequency spectrum of the first light source L1 has three peak wavelengths. The first light source L1 emitted by the first light-emitting component 210A is in a white region defined by CIEX=0.220 to 0.350 and CIEY=0.150 to 0.350 on the CIE 1931 chromaticity diagram.

One second light-emitting component 220A includes a second electroluminescent structure 222 and a wavelength-converting material 224A. The second electroluminescent structure 222 is, for example, a LED chip, which should not be construed as a limitation to the invention. The wavelength-converting material 224A is, for example, fluorescent powder or a quantum dot material, which should however not be construed as a limitation to the disclosure. When a driving current flows through the second electroluminescent structure 222, the second electroluminescent structure 222 is able to emit a primary light L2A. The primary light L2A may be converted into a secondary light L2B when the primary light L2A is irradiated onto the wavelength-converting material 224A. Generally, the primary light L2A needs to be convertible by the wavelength-converting material 224A or capable of exciting the wavelength-converting material 224A. Thereby, a peak wavelength of the primary light L2A is usually shorter than a peak wavelength of the secondary light L2B. The primary light L2A may be an ultraviolet light or a visible light.

In this embodiment, the second electroluminescent structure 222 may be a blue LED chip, and the wavelength-converting material 224A may be yellow fluorescent powder. At this time, a light-emitting frequency spectrum of a second light source L2 may be constituted by the non-converted primary light L2A and the secondary light L2B and has two peak wavelengths. Alternatively, the second electroluminescent structure 222 may be a blue LED chip, while the wavelength-converting material 224A may be red fluorescent powder and green fluorescent powder. At this time, the light-emitting frequency spectrum of the second light source L2 is constituted by the non-converted primary light L2A and two types of secondary lights L2B and has three peak wavelengths. As a result, the second light source L2 emitted by the second light-emitting component 220A may also be a white light. In the meantime, the second light source L2 emitted by the second light-emitting component 220A may fall in a white region defined by CIEX=0.220 to 0.400 and CIEY=0.150 to 0.400 on the CIE 1931 chromaticity diagram. In other words, through selecting the colors of lights emitted from the first light-emitting component 210 and the second light-emitting component 220, the first light source L1 and the second light source L2 may both provide white light and may both fall in the same white region or even on the same coordinate point on the CIE 1931 chromaticity diagram.

Figure 6:
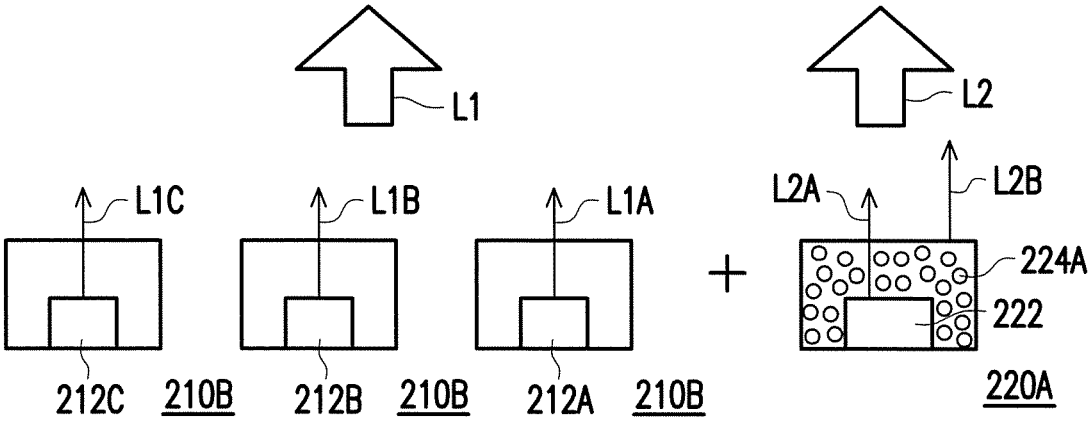
FIG. 6 is a schematic view of a combination of a first light-emitting component and a second light-emitting component in another embodiment of the disclosure.

FIG. 6 is a schematic view of a combination of a first light-emitting component and a second light-emitting component in another embodiment of the disclosure. In FIG. 6, the second light-emitting component 220A is identical to that provided in the embodiment of FIG. 5, but the first light-emitting component 210B is arranged in a group of three and each of the first light-emitting components 210B comprises only one first electroluminescent structure. Namely, the first light-emitting component in accordance with various embodiments may include one or more, i.e. at least one, electroluminescent structure. More specifically, three first light-emitting components 210B in the same group respectively include the first electroluminescent structures 212A, 212B, and 212C. The first electroluminescent structures 212A, 212B, and 212C respectively are, for example, a visible LED chip; the disclosure is not limited thereto. The first electroluminescent structures 212A, 212B, and 212C have different light-emitting peak wavelengths. The first electroluminescent structures 212A, 212B, and 212C may respectively be the first color light L1A, the second color light L1B, and the third color light L1C when a driving current flows through the first electroluminescent structures 212A, 212B, and 212C. The first color light L1A, the second color light L1B, and the third color light L1C constitute a first light source L1 of the first light-emitting component 210B. That is to say, the LED chips of the same color are packaged in a package structure, so as to serve as a first light-emitting component 210B in this embodiment.

In this embodiment, at least one of the three first light-emitting components 210B of the same group has a light-emitting peak wavelength different from the light-emitting peak wavelengths of the other two first light-emitting components 210B. The different light-emitting peak wavelengths here refer to light-emitting peak wavelengths falling in wavelength ranges of different colors, or the difference between the two wavelengths is equal to or greater than 50 nm. For example, the first color light L1A, the second color light L1B, and the third color light L1C may respectively be a red light, a blue light, and a green light, and the first light source L1 emitted by the group of the three first light-emitting components 210B may be a white light. In an embodiment, the first light source L1 emitted by the group of the three first light-emitting components 210B falls in a white region defined by CIEX=0.220 to 0.400 and CIEY=0.150 to 0.400 on the CIE 1931 chromaticity diagram. At this time, the first light source L1 and the second light source L2 may both provide white lights and serve as a display light source.

Figure 2:
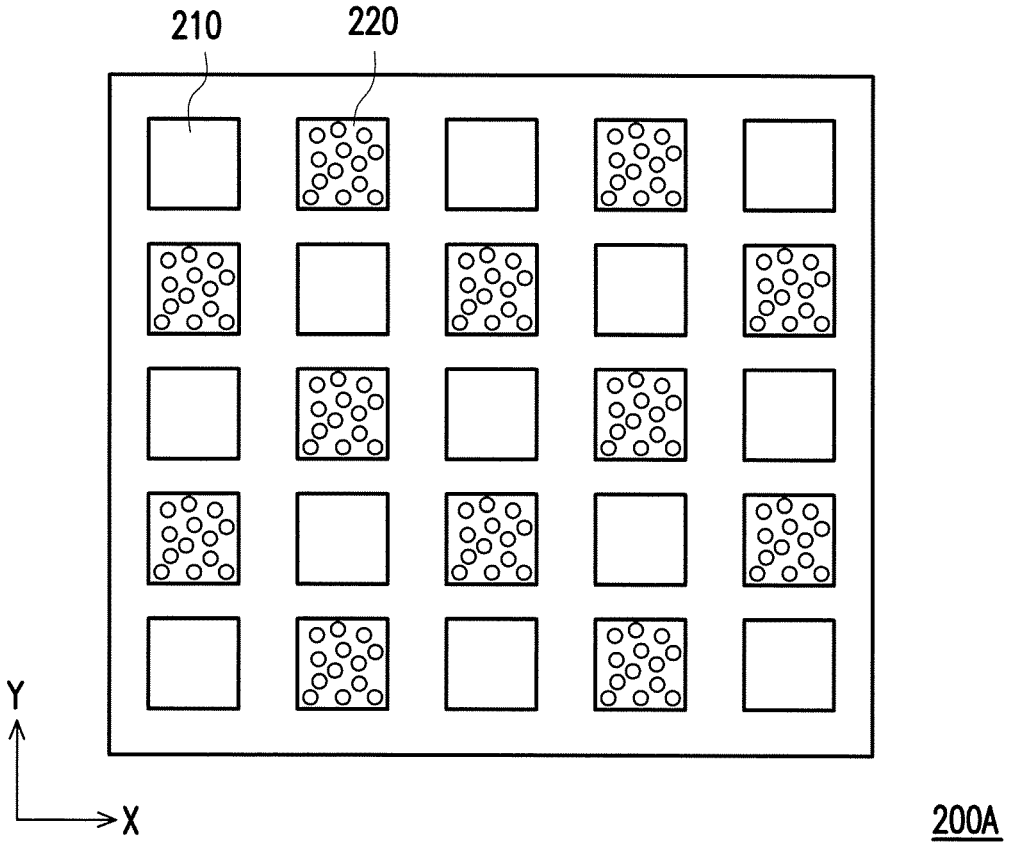
FIG. 2 is a schematic top-view of a light source module in the display device of FIG. 1.

When the embodiment depicted in FIGS. 5 and 6 is applied to the display device 10A in FIG. 1 or the display device 10B in FIG. 2, the display light source L provided to the display panel 100 may be constituted by at least one of the first light source L1 and the second light source L2. For example, when the display device 10A in FIG. 1 or the display device 10B in FIG. 3 displays a white frame, both of or one of the first light source L1 or the second light source L2 may be selected as the display light source L because both the first light source L1 and the second light source L2 provide white light. That is to say, in some embodiments, the display light source L may be provided solely by the second light-emitting component (220, 220A, or 220B) or solely by the first light-emitting component (210, 210A, or 210B). If only the second light source L2 is selected as the light source, the electric energy consumed by providing the display light source L may be reduced because no driving current is required to be provided to the first light-emitting component 210A or 210B. Additionally, the first light source L1 may have a better color rendering property because the first light source L1 is provided by the electroluminescent structures (the LED chips) of three colors. Thereby, when the display device 10A in FIG. 1 or the display device 10B in FIG. 3 displays a colorful frame, the display light source L may be solely provided by the first light source L1. When the first light source L1 solely serves as the display light source L, a NTSC (National Television System Committee) color gamut coverage rate of the display device 10A or 10B may reach 85% or higher and meet the standards of BT.2020. The display quality of the display device 10A or 10B thus meets the market demands. Nevertheless, the disclosure is not limited to the above. When the display device 10A in FIG. 1 or the display device 10B in FIG. 3 displays a colorful frame, the first light source L1 and the second light source L2 may be both selected to provide the required display light source L. For example, if the required display light source L is set to include a blue light with the intensity of 192 units, a green light with the intensity of 225 units, and a red light with the intensity of 128 units, and when the required display light source L is implemented in the manner provided in the embodiment illustrated in FIG. 5 or FIG. 6, the second light-emitting component 220A may be partially turned on to provide a light with the intensity of 128 units. At this time, the second light-emitting component 220A may provide a blue light with the intensity of 128 units, a green light with the intensity of 128 units, and a red light with the intensity of 128 units. Meanwhile, an electroluminescent structure (an LED chip) of the first light-emitting component 210A (or the group of the three second light-emitting components 210B) which emits blue light is further applied to provide a blue light with the intensity of 64 units, and an electroluminescent structure (an LED chip) of the first light-emitting component 210A (or the group of the three second light-emitting components 210B) which emits green lights is further applied to provide a green light with the intensity of 127 units. As a result, compared to the situation where the required display light source L is implemented in form of solely turning on the first light-emitting component 210A (or the group of three second light-emitting components 210B), the situation described herein may lead to the reduced energy consumption because the second light-emitting component 220A merely requires the driving current of one LED chip to provide a portion of intensity required by each color light.

Both the first light source L1 and the second light source L2 in the embodiment of FIG. 5 and FIG. 6 are white light sources. Nevertheless, the disclosure is not limited to the above. In other embodiments, the second electroluminescent structure 222 in the second light-emitting component 220A may be an ultraviolet light LED chip, while the wavelength-converting material 224A may be yellow fluorescent powder (or red fluorescent powder and green fluorescent powder). At this time, the second light source L2 is substantially the yellow light (red light or green light). Alternatively, the second electroluminescent structure 222 in the second light-emitting component 220A may be a blue LED chip, while the wavelength-converting material 224A may be green fluorescent powder, such that the second light source L2 is a cyan light. In another alternative embodiment, the second electroluminescent structure 222 in the second light-emitting component 220A may be a blue LED diode chip, while the wavelength-converting material 224A may be red fluorescent powder, such that the second light source L2 is a purple light. Since the second light source L2 does not need to be a white light, the display light source L provided to the display panel 100 needs to be constituted by the first light source L1 and the second light source L2 to form a white light source if the embodiment depicted in FIGS. 5 and 6 is applied to the display device 10A in FIG. 1 or the display device 10B in FIG. 3.

Figure 7:
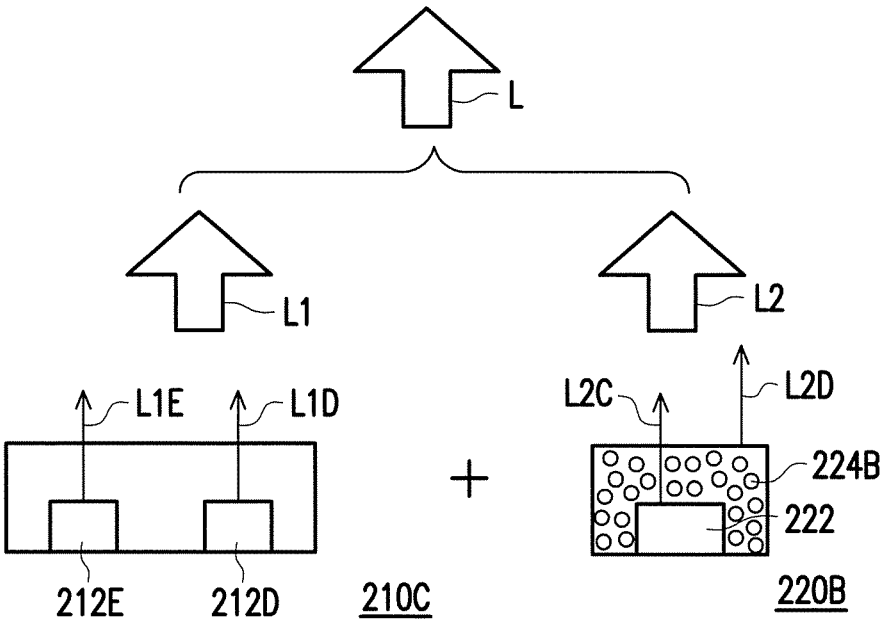
FIG. 7 is a schematic view of a combination of a first light-emitting component and a second light-emitting component in yet another embodiment of the disclosure.

FIG. 7 is a schematic view of a combination of a first light-emitting component and a second light-emitting component in yet another embodiment of the disclosure. According to FIG. 7, a first light-emitting component 210C includes a plurality of first electroluminescent structures 212D and 212E. The first electroluminescent structure 212D and the first electroluminescent structure 212E are packaged in the same package. Nevertheless, the disclosure is not limited thereto, and the first electroluminescent structure 212D and the first electroluminescent structure 212E may also be packaged in different packages (not depicted). In this embodiment, the first electroluminescent structure 212D and the first electroluminescent structure 212E have different light-emitting peak wavelengths. When a driving current flows through the first electroluminescent structure 212D and the first electroluminescent structure 212E, the first electroluminescent structure 212D and the first electroluminescent structure 212E may respectively emit a fourth color light L1D and a fifth color light L1E. In an embodiment, the fourth color light L1D and the fifth color light L1E may respectively be a red light and a blue light or a green light and a blue light. The disclosure is not limited to the above. When the fourth color light L1D and the fifth color light L1E are respectively the red light and the blue light, the first light source L1 emitted by the first light-emitting component 210C is not a white light but a purple light. When the fourth color light L1D and the fifth color light L1E are respectively the green light and the blue light, the first light source L1 emitted by the first light-emitting component 210C is not a white light but a cyan light. In other embodiments, the first electroluminescent structure 212D and the first electroluminescent structure 212E may respectively be packaged in different packages which constitute a light-emitting component assembly for providing the first light source L1.

Additionally, in this embodiment, the second light-emitting component 220B includes a second electroluminescent structure 222 and a wavelength-converting material 224B. The second electroluminescent structure 222 is, for example, a LED chip, while the wavelength-converting material 224B is, for example, fluorescent powder. The disclosure is not limited to the above. When a driving current flows through the second electroluminescent structure 222, the second electroluminescent structure 222 may emit a primary light L2C. The primary light L2C is irradiated onto the wavelength-converting material 224B and is converted by the wavelength-converting material 224B into a secondary light L2D. The second light source L2 emitted by the second light-emitting component 220B is constituted by the secondary light L2D and a portion of the non-converted primary light L2C. For example, the second electroluminescent structure 222 may be a blue LED chip or a purple LED chip, while the wavelength-converting material 224B may be at least one of yellow fluorescent powder, green fluorescent powder, and red fluorescent powder.

The color of the second light source L2 or the wavelength-converting material 224B of the second light-emitting component 220B may be determined or adjusted according to different needs and the color of the first light source L1 of the first light-emitting component 210C. For example, the wavelength-converting material 224B of the second light-emitting component 220B may be green fluorescent powder when the fourth color light L1D and the fifth color light L1E of the first light-emitting component 210C are respectively a red light and a blue light. As a result, the display light source L constituted by the first light source L1 emitted from the first light-emitting component 210C and the second light source L2 emitted from the second light-emitting component 220B may be a white light. Alternatively, the wavelength-converting material 224B of the second light-emitting component 220B may be red fluorescent powder when the fourth color light L1D and the fifth color light L1E of the first light-emitting component 210C are respectively a green light and a blue light. As a result, the display light source L constituted by the first light source L1 emitted from the first light-emitting component 210C and the second light source L2 emitted from the second light-emitting component 220B may be a white light.

In the above-mentioned embodiment, color lights (the first, second, third, fourth, and fifth color lights) emitted from the first light-emitting component are not limited and may be adjusted according to the requirements of displays. The primary light emitted from the second light-emitting component and the wavelength-converting material are not limited and may be adjusted according to the requirements of displays.

Overall, the first light-emitting component having no wavelength-converting material (including but not limited to fluorescent powder) and the second light-emitting component having the wavelength-converting material (including but not limited to fluorescent powder) are applied to provide display lights in the aforementioned embodiments. As a result, a better color display quality (such as a good color rendering index) may be achieved by the first light-emitting component, and the energy consumption is reduced because the second light-emitting component is merely required to drive one LED chip. Thereby, the display device is able to have good efficiency and ideal display quality.

Figure 8:
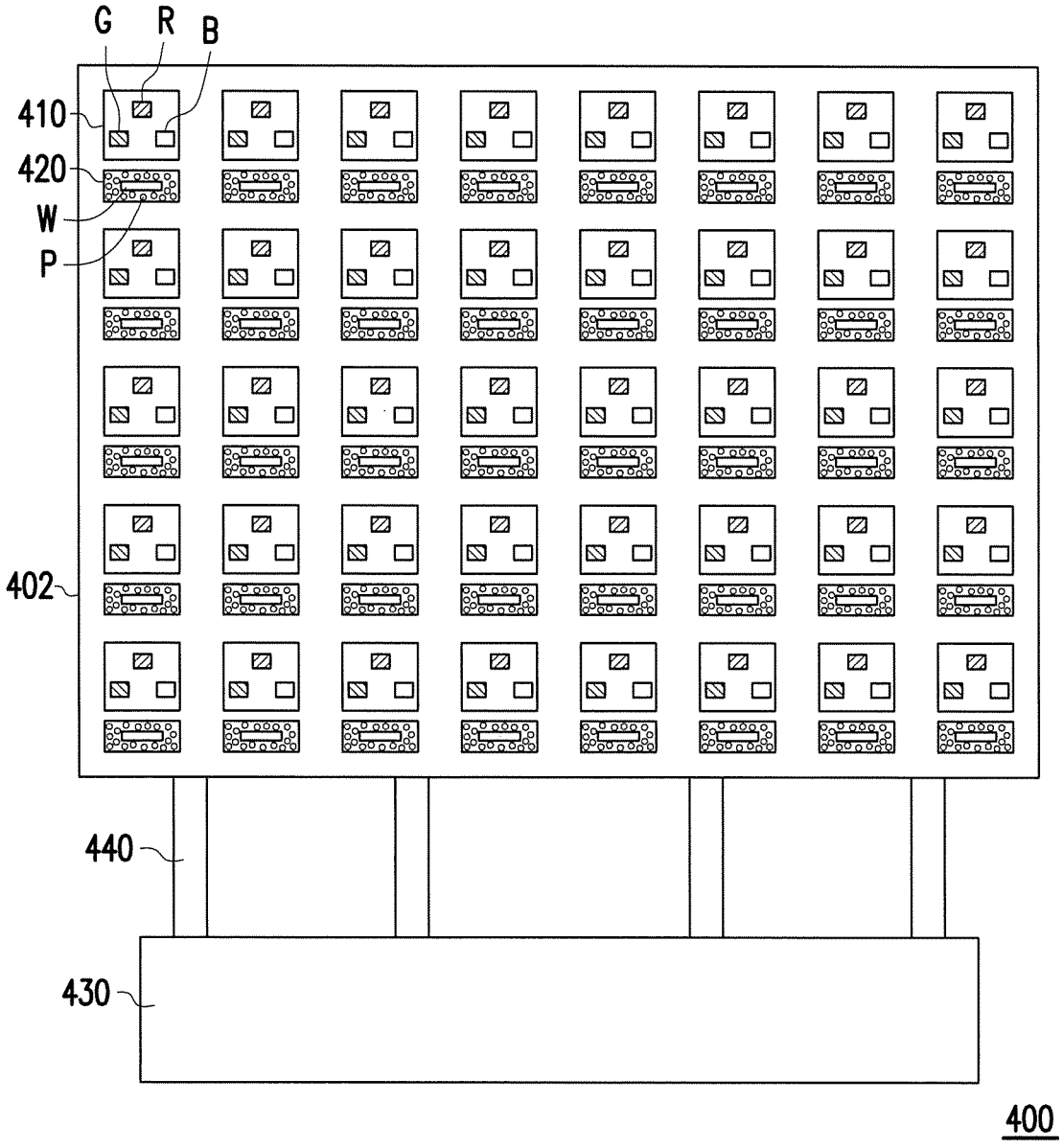
FIG. 8 is a schematic view of a portion of a light source module in an embodiment of the disclosure.

FIG. 8 is a schematic view of a portion of a light source module in an embodiment of the disclosure. According to FIG. 8, a light source module 400 includes a substrate 402, a plurality of first light-emitting components 410, a plurality of second light-emitting components 420, a driver circuit 430, connection lines 440, and a plurality of micro controllers disposed on an opposite side of the substrate 402 (not shown in the drawing). More specifically, the first light-emitting components 410, the second light-emitting components 420, and the micro controllers are all disposed on the substrate 402, wherein the first light-emitting components 410 and the second light-emitting components 420 are disposed on one side of the substrate 402, while the micro controllers are disposed on an opposite side of the substrate 402. Hence, the micro controllers are not shown in FIG. 8. The substrate 402 and the driver circuit 430 may be connected through the connection lines 440. The connection lines 440 may be a bus or other circuit structures capable of providing a transmission path for electric signals. The driver circuit 430 may be connected to the micro controllers through the connection lines 440, and the micro controllers may be electrically connected to each of the first light-emitting components 410 and the second light-emitting components 420. The driver circuit 430 may provide a driving signal to the micro controllers, and the micro controllers may control light-emitting brightness of each of the first light-emitting components 410 and the second light-emitting components 420 based on the signal provided by the driver circuit 430. Moreover, each of the first light-emitting components 410 and the second light-emitting components 420 may be electrically connected to the driver circuit 430 through the transmission path for electric signals that is provided by the connection lines 440. The light source module 400 may be applied in the display device in FIG. 1 to replace the light source module 200A, or the light source module 400 may be directly applied in other devices that require a planar light source.

In this embodiment, each of the first light-emitting components 410 includes three first electroluminescent structures R, G, and B, and each of the second light-emitting components 420 includes a second electroluminescent structure W and a wavelength-converting material P. The electroluminescent structures here may be LED chips, which should however not be construed as a limitation to the disclosure. The first electroluminescent structure R is able to emit, for example, a red light after a driving current is applied onto the first electroluminescent structure R. The first electroluminescent structure G is able to emit, for example, a green light after a driving current is applied onto the first electroluminescent structure G. The first electroluminescent structure B is able to emit, for example, a blue light after a driving current is applied onto the first electroluminescent structure B. Since each of the first light-emitting components 410 includes three first electroluminescent structures R, G, and B, the first light-emitting components 410 are able to emit white lights. The second electroluminescent structure W of the second light-emitting components 420 is able to emit, for example, a blue light after a driving current is applied onto the second electroluminescent structure W. The wavelength-converting material P of the second light-emitting components 420 may be yellow fluorescent powder, so as to convert the blue light emitted by the second electroluminescent structure W to a yellow light. In another embodiment, the wavelength-converting material P of the second light-emitting components 420 may include red fluorescent powder and green fluorescent powder, so as to convert the blue light emitted by the second electroluminescent structure W to a red light and a green light. Hence, the second light-emitting components 420 are able to emit a white light on their own. In other embodiments, however, the second electroluminescent structure W of the second light-emitting components 420 may emit, for example, an invisible light (such as an ultraviolet light) after a driving current is applied onto the second electroluminescent structure W. At this time, the light emitted by the second light-emitting components 420 emit is not a white light.

In this embodiment, the light-emitting components among the first light-emitting components 410 and the second light-emitting components 420 with substantially identical driving voltage may be connected to the driver circuit through a common connection line 440. For example, the first electroluminescent structures R of all of the first light-emitting components 410 may be cascaded together and electrically connected to the driver circuit 430 through the transmission path for electric signals that is provided by the connection lines 440. In the same manner, the first electroluminescent structures G of all the first light-emitting components 410 may be cascaded together and electrically connected to the driver circuit 430 through the transmission path for electric signals that is provided by the connection lines 440. The first electroluminescent structures B of all the first light-emitting components 410 may be cascaded together and electrically connected to the driver circuit 430 through the transmission path for electric signals that is provided by the connection lines 440. The driver circuit 430 is able to output a driving voltage corresponding to the driving voltage required by different electroluminescent structures emitting different colors of lights. For example, a red electroluminescent structure (or a red LED chip) requires a lower driving voltage than a blue or green electroluminescent structure (or a blue or green LED chip). Thereby, the driving voltage required by the red electroluminescent structure (or the red LED chip) may be transmitted by an independent connection line 440. The driving voltages required by other electroluminescent structures (LED chips) may be integrated and transmitted by another connection line 440. Furthermore, the driver circuit 430 is able to receive feedback signals transmitted back by the electroluminescent structures emitting different colors of lights, so as to determine if a driving voltage needs to be adjusted.

Figure 9:
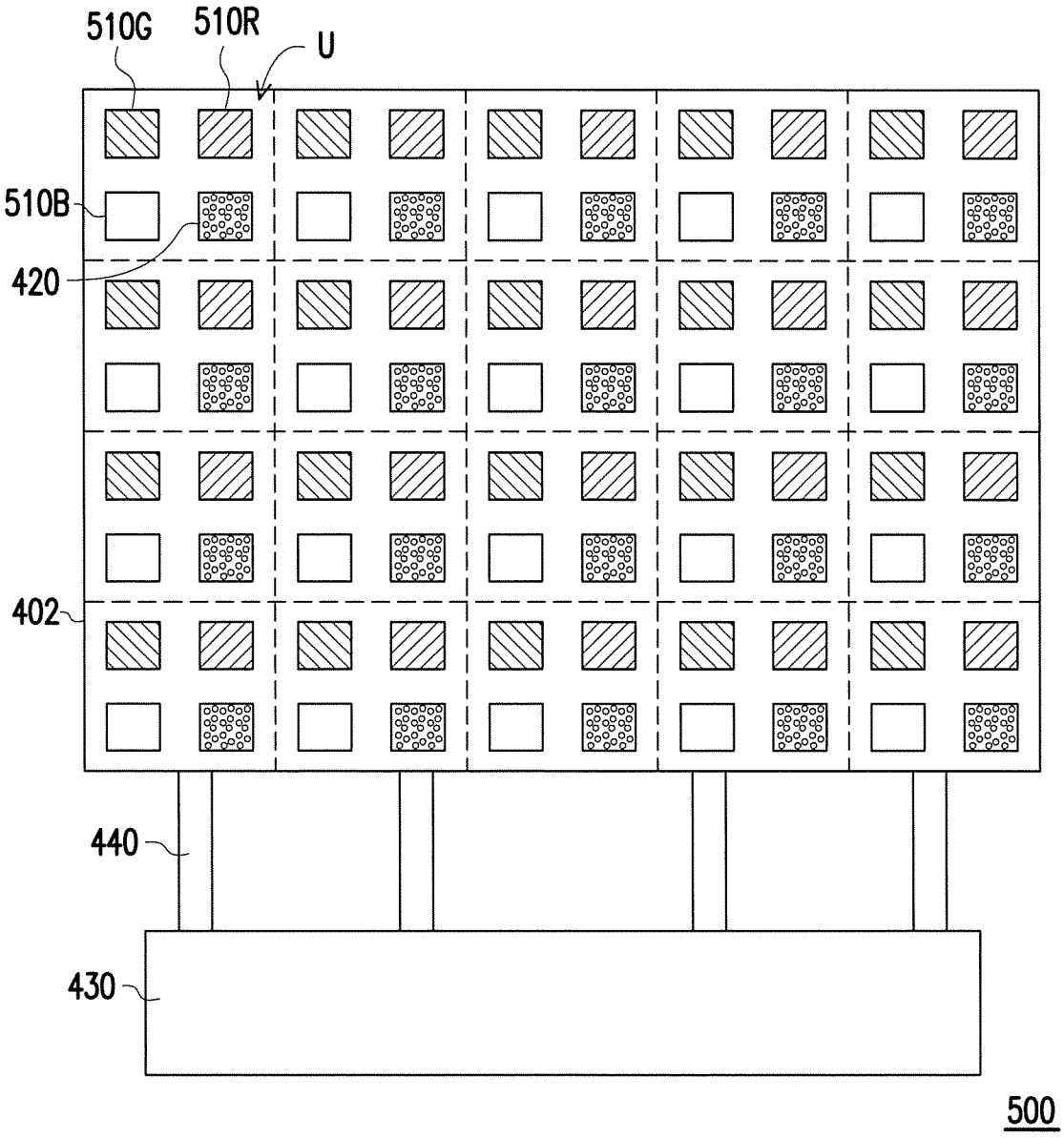
FIG. 9 is a schematic view of a portion of a light source module in another embodiment of the disclosure.

FIG. 9 is a schematic view of a portion of a light source module in another embodiment of the disclosure. According to FIG. 9, a light source module 500 includes a substrate 402, a plurality of first light-emitting components 510R, 510G, and 510B, a plurality of second light-emitting components 420, a driver circuit 430, connection lines 440, and a micro controller. More specifically, the first light-emitting components 510R, 510G, and 510B, the second light-emitting components 420, and the micro controller are all disposed on the substrate 420, wherein the first light-emitting components 510R, 510G, and 510B and the second light-emitting components 420 are disposed on one side of the substrate 402, while the micro controller is disposed on an opposite side of the substrate 402. Thereby, the micro controller is not shown n FIG. 9. The substrate 402 and the driver circuit 430 may be connected through the connection lines 440. The connection lines 440 are capable of providing a transmission path for electric signals. The driver circuit 430 may be electrically connected to the micro controller through the connection lines 440, and the micro controller may be electrically connected to each of the first light-emitting components 510R, 510G, 510B and the second light-emitting components 420. Moreover, each of the first light-emitting components 510R, 510G, 510B and the second light-emitting components 420 may also be electrically connected to the driver circuit 430 through the transmission path for electric signals that is provided by the connection lines 440. The light source module 500 may be applied to the display device in FIG. 1 to replace the light source module 200A, or the light source module 500 may be directly applied in other devices that require a planar light source.

More specifically, in this embodiment, each of the first light-emitting components 510R, 510G and 510B includes a first electroluminescent structure. For example, the first light-emitting component 510R includes a red electroluminescent structure, the first light-emitting component 510G includes a green electroluminescent structure, and the first light-emitting component 510B includes a blue electroluminescent structure. Each of the second light-emitting structures 420 is substantially similar to the second light-emitting components 420 provided in the embodiment depicted in FIG. 8 and thus will not be further explained. Moreover, the electroluminescent structures here may be LED chips, which should however not be construed as a limitation in the disclosure. Thereby, the three first light-emitting components 510R, 510G, and 510B constitute a light-emitting component assembly that is able to emit white lights. In this embodiment, the light source module 500 may be divided into a plurality of unit regions U. Three first light-emitting components 510R, 510G, and 510B and one second light-emitting component 420 are disposed in each of the unit regions U. As a result, each of the unit regions U is able to emit a white light through the group of the three first light-emitting components 510R, 510G, and 510B or through the second light-emitting component 420.

In this embodiment, all the first light-emitting components 510R may be cascaded together and electrically connected to the driver circuit 430 through the transmission path for electric signals that is provided by the connection lines 440. In the same manner, all the first light-emitting components 510G may be cascaded together and electrically connected to the driver circuit 430 through the transmission path for electric signals that is provided by the connection lines 440. All the first light-emitting components 510B may be cascade together and electrically connected to the driver circuit 430 through the transmission path for electric signals that is provided by the connection lines 440. Furthermore, a method of transmitting signals between the driver circuit 430 and the first light-emitting components 510R, 510G, and 510B may refer to the content of the embodiment shown in FIG. 8.

Temperatures of the first light-emitting components 510R, 5106, and 510B and the second light-emitting component 420 gradually increase when the first light-emitting components 510R, 510G, and 510B and the second light-emitting component 420 are turned on and emit lights. Meanwhile, the first light-emitting component 510R, the first light-emitting component 510G, the first light-emitting component 510B, and the second light-emitting component 420 have different sensitivities to the temperature. Thereby, voltage drops across the first light-emitting component 510R, the first light-emitting component 510G, the first light-emitting component 510B, and the second light-emitting component 420 may be changed to different degrees in response to the changes of temperature. Generally, the voltage drops across the light-emitting components decrease as the temperatures of the light-emitting components increase, and a light-emitting effect of the light-emitting components is more likely to degrade. The light-emitting components may even be deteriorated or be damaged. Thereby, the voltage drop across the first light-emitting components 510R, 5106, and 510B and the second light-emitting component 420 may be measured in this embodiment to determine if the temperatures of the first light-emitting components 510R, 510G, and 510B and the second light-emitting component 420 exceed a tolerable range and thereby determine whether the driving signals need to be adjusted. In an embodiment, the voltage drop across the first light-emitting components 510R, 510G, and 510B and the second light-emitting component 420 may be obtained through measuring the voltage drop across individual light-emitting components. Alternatively, all the first light-emitting components 510R may be cascaded together, all the first light-emitting components 510G may be cascaded together, and all the first light-emitting components 510B may be cascaded together. In this case, whether the temperatures of the first light-emitting components 510R, 510G, and 510B and the second light-emitting component 420 exceed a tolerable range and whether the driving signals need to be adjusted may be determined by measuring the voltage drop across the cascaded light-emitting components.

Figure 10:
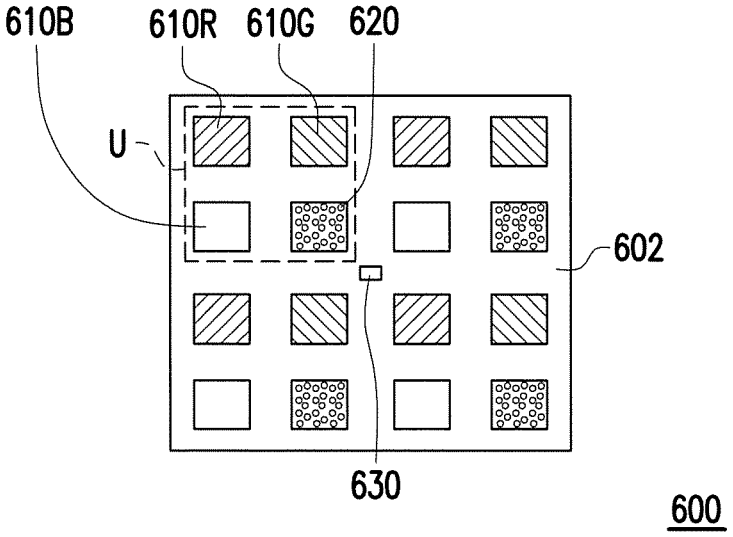
FIG. 10 is a schematic view of a portion of a light source module in yet another embodiment of the disclosure.

FIG. 10 is a schematic view of a portion of a light source module in yet another embodiment of the disclosure. According to FIG. 10, a light source module 600 includes a substrate 602, a plurality of the first light-emitting components 610R, 610G, and 610B, a plurality of second light-emitting components 620, and a sensor 630. The first light-emitting components 610R, 6106, and 610B, the second light-emitting components 620, and the sensor 630 are disposed on the substrate 602 side by side. The first light-emitting components 610R, 610G, and 610B are respectively configured to emit a red light, a green light, and a blue light. The second light-emitting components 620 are configured to emit a white light. The sensor 630 may be electrically connected to a driver circuit of the light source module 600. After the sensor 630 transmits signals sensed by the sensor 630 to the driver circuit, the driver circuit is able to determine if the first light-emitting components 610R, 610G, and 610B and the second light-emitting components 620 operate normally based on the signals transmitted from the sensor 630, and thereby the driver circuit may adjust the driving signals of the first light-emitting components 610R, 610G, and 610B and the second light-emitting components 620 according to the signals transmitted from the sensor 630. As a result, the light source module 600 is able to achieve a desired light-emitting effect.

One first light-emitting component 610R, one first light-emitting component 610G, one first light-emitting component 610B, and one second light-emitting component 620 may constitute a unit region U. In this embodiment, the sensor 630 may be located in a center of four unit regions U, which is merely exemplary in the present embodiment. In other embodiments, the location and the distribution density of the sensor 630 may be adjusted according to the requirements for designing the light source module 600. For example, in the light source module 600, a plurality of the sensors 630 may be disposed more densely in some of the regions that require a great light-emitting effect. Alternatively, the sensors 630 may be evenly distributed in the entire light source module 600.

In an embodiment, the sensor 630 may be an optical sensor configured to sense light-emitting effects of the first light-emitting components 610R, 610G, and 610B and the second light-emitting components 620. The sensor 630 is able to transmit frequency spectrums of lights sensed by the sensor 630 to a driver circuit, whereby the driving signals of the first light-emitting components 610R, 610G, and 610B and the second light-emitting components 620 may be adjusted. For example, when the light source module 600 is turned on for a period of time, the driver circuit may increase the electric current provided to a red light-emitting component (e.g., the first light-emitting component 610R) or decrease the electric currents provided to blue and green light-emitting components (e.g., the first light-emitting component 610B and 610G) based on a sensing result of the sensor 630 if a decreasing degree of the brightness of a red light wavelength range in the frequency spectrums of lights sensed by the sensor 630 is more obvious than of other color lights. Alternatively, the driver circuit may adjust the electric currents or the driving signals of the first light-emitting component 610R, 610G, and 610B and the second light-emitting components 620 based on the sensing result of the sensor 630 if the frequency spectrum of light sensed by the sensor 630 does not match a target frequency spectrum. Thereby, the light source module 600 is able to achieve a desired light-emitting effect.

In another embodiment, the sensor 630 may be a thermal sensor configured to sense a temperature in the light source module 600. The sensor 630 is able to transmit the temperature sensed by the sensor 630 to the driver circuit, whereby the driving signals of the first light-emitting components 610R, 610G, and 610B and the second light-emitting components 620 may be adjusted. For example, the first light-emitting component 610R, the first light-emitting component 610G, the first light-emitting component 610B, and the second light-emitting components 620 have different sensitivities to temperature. When the light source module 600 is turned on for a period of time, the sensor 630 senses an obvious increase in the temperature, and the driver circuit is then able to adjust the driving signal of the light-emitting component which is more sensitive to the temperature based on the sensing result of the sensor 630. Accordingly, the degradation of or damages to the light-emitting components may be improved to a better extent.

To sum up, the display device and the light source module of the disclosure adopt two types of light-emitting components to provide the light source. One type of the light-emitting components includes the wavelength-converting material and saves more energy, and the other type of the light-emitting components does not include any wavelength-converting material and exhibits a better color display quality. Thereby, the display device and the light source module of the disclosure are able to maintain an ideal color display quality without consuming significant energy.

It will be apparent to those skilled in the art that various modifications and variations can be made to the structure of the present disclosure without departing from the scope or spirit of the disclosure. In view of the foregoing, it is intended that the present disclosure cover modifications and variations of this invention provided they fall within the scope of the following claims and their equivalents.

What is claimed is:

1. A display device comprising:

a display panel; and a light source module arranged on a side of the display panel and providing a display light source to the display panel, the light source module comprising at least one first light-emitting component and at least one second light-emitting component, the at least one first light-emitting component comprising at least one first electroluminescent structure, the at least one second light-emitting component comprising a second electroluminescent structure, wherein the at least one second light-emitting component further comprises a wavelength-converting material, but the at least one first light-emitting component does not comprise any wavelength-converting material.

2. The display device of claim 1, wherein the wavelength-converting material of the at least one second light-emitting component converts a primary light emitted by the second electroluminescent structure into a secondary light, and a peak wavelength of the primary light is shorter than a peak wavelength of the secondary light.

3. The display device of claim 1, wherein a quantity of the at least one first light-emitting component is plural, each of the first light-emitting components comprises only one first electroluminescent structure, and at least two of the plural first light-emitting components are categorized into one group, wherein the at least two of the plural first light-emitting components in the group emit visible lights of different peak wavelengths.

4. The display device of claim 3, wherein at least one of the at least two of the plural first light-emitting components in the group has a first light-emitting peak wavelength, the second electroluminescent structure of the at least one second light-emitting component has a second light-emitting peak wavelength, and the first light-emitting peak wavelength is different from the second light-emitting peak wavelength.

5. The display device of claim 1, wherein a quantity of the at least one first electroluminescent structure of the at least one first light-emitting component is three, and wherein the three first electroluminescent structures emit visible lights of different peak wavelengths.

6. The display device of claim 1, wherein a quantity of the at least one first light-emitting component in the display device equals a quantity of the at least one second light-emitting component in the display device.

7. The display device of claim 1, wherein the light source module further comprises a driver circuit, and the at least one first light-emitting component and the at least one second light-emitting component are connected to the driver circuit through a plurality of connection lines, wherein the at least one first light-emitting component with a substantially identical driving voltage are connected to the driver circuit through a common connection line.

8. The display device of claim 1, wherein the display light source is provided solely by the at least one first light-emitting component or solely by the at least one second light-emitting component.

9. The display device of claim 1, wherein the light source module further comprises a sensor, and the sensor, the at least one first light-emitting component, and the at least one second light-emitting component are arranged side by side.

10. A light source device comprising:

a plurality of first light-emitting components, wherein one of the first light-emitting components comprises at least one first electroluminescent structure; and a plurality of second light-emitting components, wherein one of the second light-emitting components comprises a second electroluminescent structure, wherein the one of the second light-emitting components further comprises a wavelength-converting material, but the one of the first light-emitting components does not comprise a wavelength-converting material.

11. The light source device of claim 10, wherein the wavelength-converting material of the one of the second light-emitting components converts a primary light emitted by the second electroluminescent structure into a secondary light, and a peak wavelength of the primary light is shorter than a peak wavelength of the secondary light.

12. The light source device of claim 10, wherein each of the first light-emitting components comprises only one first electroluminescent structure, and at least two of the first light-emitting components are categorized into one group, wherein the at least two of the first light-emitting components in the group emit visible lights of different peak wavelengths.

13. The light source device of claim 12, wherein at least one of the first electroluminescent structures in the group has a first light-emitting peak wavelength, the second electroluminescent structure of the one of the second light-emitting components has a second light-emitting peak wavelength, and the first light-emitting peak wavelength is different from the second light-emitting peak wavelength.

14. The light source device of claim 10, wherein a quantity of the at least one first electroluminescent structures of the one of the first light-emitting components is three, and wherein the three first electro luminescent structures emit visible lights of different peak wavelengths.

15. The light source device of claim 10, wherein a quantity of the first light-emitting components in the light source device equals a quantity of the second light-emitting components in the light source device.

16. The light source device of claim 10, further comprises a driver circuit, wherein the first light-emitting components and the second light-emitting components are connected to the driver circuit through a plurality of connection lines, wherein the first light-emitting components with a substantially identical driving voltage are connected to the driver circuit through a common connection line.

17. The light source device of claim 10, wherein the first light-emitting components are solely turned on or the second light-emitting components are solely turned on.

18. The light source device of claim 10 further comprises a sensor, wherein the sensor, the first light-emitting components, and the second light-emitting components are arranged side by side.

* * * * *